US010700425B2

(12) United States Patent
Li

(10) Patent No.: US 10,700,425 B2
(45) Date of Patent: Jun. 30, 2020

(54) MULTI-FEED ANTENNA

(71) Applicants: Inventec (Pudong) Technology Corporation, Shanghai (CN); INVENTEC CORPORATION, Taipei (TW)

(72) Inventor: Chih-Cheng Li, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 16/214,350

(22) Filed: Dec. 10, 2018

(65) Prior Publication Data

US 2020/0168988 A1 May 28, 2020

(30) Foreign Application Priority Data

Nov. 28, 2018 (CN) ..... 2018 1 1433065

(51) Int. Cl.

| | |
|---|---|
| ***H01Q 1/52*** | (2006.01) |
| ***H01Q 5/35*** | (2015.01) |
| ***H01Q 7/00*** | (2006.01) |
| ***H01Q 9/30*** | (2006.01) |
| ***H01Q 1/24*** | (2006.01) |

(52) U.S. Cl.

CPC ..... *H01Q 1/521* (2013.01); *H01Q 1/243* (2013.01); *H01Q 7/00* (2013.01); *H01Q 9/30* (2013.01); *H01Q 5/35* (2015.01)

(58) Field of Classification Search

CPC ..... H01Q 1/521; H01Q 1/243; H01Q 7/00; H01Q 9/30; H01Q 5/35

See application file for complete search history.

(56) References Cited

U.S. PATENT DOCUMENTS

2013/0069842 A1* 3/2013 Lee ..... H01Q 1/521 343/853

2016/0164168 A1* 6/2016 Choi ..... H01Q 1/243 343/702

* cited by examiner

*Primary Examiner* — Hai V Tran

*Assistant Examiner* — Michael M Bouizza

(74) *Attorney, Agent, or Firm* — Locke Lord LLP; Tim Tingkang Xia, Esq.

(57) ABSTRACT

A multi-feed antenna comprises a first antenna component, a second antenna component, a metal board and an isolation assembly. The first antenna component comprises a first signal feed-in terminal and a first free end, with the first signal feed-in terminal configured for receiving a first feed-in signal. The second antenna component comprises a second signal feed-in terminal and a second free end, with the second signal feed-in terminal configured for receiving a second feed-in signal. The metal board comprises a first section, a second section and a third section between the first and second sections. The first section and the first free end define a first gap therebetween, and the second section and the second free end define a second gap therebetween. The isolation assembly is electrically connected with the third section, comprises a ground terminal, and is configured for isolating the first and second feed-in signals.

18 Claims, 4 Drawing Sheets

MULTI-FEED ANTENNA

CROSS-REFERENCE TO RELATED APPLICATIONS

This non-provisional application claims priority under 35 U.S.C. § 119(a) on Patent Application No(s). 201811433065.X filed in China on Nov. 28, 2018, the entire contents of which are hereby incorporated by reference.

BACKGROUND

1. Technical Field

This disclosure relates to an antenna, and particularly to a multi-feed antenna.

2. Related Art

Wireless communication technology is a way of exchanging information by utilizing the ability of electromagnetic wave signals to propagate in free space. Recently, there has been an explosive development in the wireless communication due to widespread demand. After the evolution of multi-generation mobile communication technologies, the fifth-generation (5G) international standard for mobile communication technology has been established. In comparison with the fourth-generation (4G) mobile communication technology, 5G mobile communication technology has the higher data transmission rate and one of its purposes is to satisfy the requirements of different communication such as near filed communication and long distance communication.

In order to comply with the standards of the 5G mobile communication technology, the design of a multi-feed antenna is a necessary and low-cost option. However, as the consumers' requirements for the appearance of electronic products are higher, the screen-to-body ratio of the electronic products is increasing. The placement of antennas is limited, and the distance between the antennas or the distance between the antennas and other components of the electronic products is decreased. As a result, the coupling between the antennas or between the antennas and other metal components becomes more serious, and even reduces the quality of the wireless communication of the antennas.

SUMMARY

This disclosure provides a multi-feed antenna.

According to an embodiment of this disclosure, a multi-feed antenna comprises a first antenna component, a second antenna component, a metal board and an isolation assembly. The first antenna component comprises a first signal feed-in terminal and a first free end, with the first signal feed-in terminal configured for receiving a first feed-in signal. The second antenna component comprises a second signal feed-in terminal and a second free end, with the second signal feed-in terminal configured for receiving a second feed-in signal. The metal board comprises a first section, a second section and a third section between the first section and the second section. The first section and the first free end define a first gap therebetween, and the second section and the second free end define a second gap therebetween. The isolation assembly is electrically connected with the third section of the metal board, and comprises a ground terminal. The isolation assembly is configured for isolating the first feed-in signal and the second feed-in signal.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
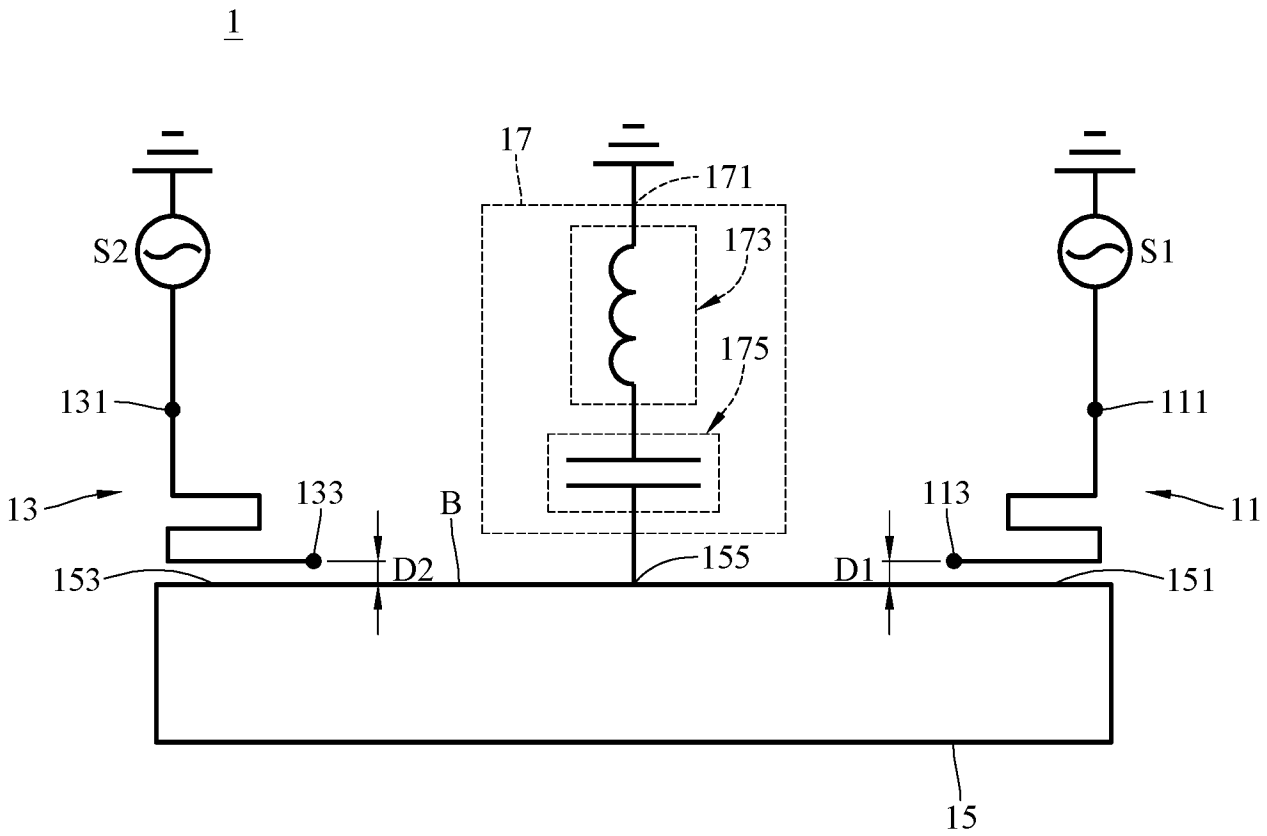
FIG. 1 is a schematic diagram of a multi-feed antenna according to an embodiment of this disclosure.

Please refer to FIG. 1, wherein FIG. 1 is a schematic diagram of a multi-feed antenna 1 according to an embodiment of this disclosure. As shown in FIG. 1, the multi-feed antenna 1 comprises a first antenna component 11, a second antenna component 13, a metal board 15 and an isolation assembly 17. The first antenna component 11 comprises a first signal feed-in terminal 111 and a first free end 113. The first signal feed-in terminal 111 is configured for receiving a first feed-in signal from a first signal source S1. The first free end 113 and the metal board 15 are separated from each other to form a first gap D1 therebetween. The second antenna component 13 comprises a second signal feed-in terminal 131 and a second free end 133. The second signal feed-in terminal 131 is configured for receiving a second feed-in signal from a second signal source S2. The second free end 133 and the metal board 15 are separated from each other to form a second gap D2 therebetween.

The metal board 15 is separated from the first antenna component 11 and the second antenna component 13 respectively with the aforementioned first and second gaps D1 and D2, and electrically connected with the isolation assembly 17. The metal board 15 comprises a first section 151 and a second section 153, wherein the first section 151 and the first free end 113 of the first antenna component 11 define the aforementioned first gap D1 together, and the second section 153 and the second free end 133 of the second antenna component 13 define the aforementioned second gap D2 together. In other words, the first section 151 of the metal board 15 is close to the first free end 113 of the first antenna component 11 but far from the second free end 133 of the second antenna component 13; on the other hand, the second section 153 is close to the second free end 133 of the second antenna component 13 but far from the first free end 113 of the first antenna component 11. The metal board 15 also comprises a third section 155 between the first section 151 and the second section 153. The third section 155 is electrically connected with the isolation assembly 17, with the isolation assembly 17 configured for isolating the first feed-in signal from the second feed-in signal. The detailed composition of the isolation assembly 17 is described below.

In the embodiment as shown in FIG. 1, the metal board 15 comprises a side edge B. This side edge B comprises the first section 151, the second section 153 and the third section 155 as mentioned before. In other words, the first section 151, the second section 153 and the third section 155 are respectively formed by three side edge sections, wherein these three side edge sections are included in the side edge B. In this embodiment, the first antenna component 11, the second antenna component 13 and the isolation assembly 17 are disposed on the same side of the metal board 15, and the isolation assembly 17 is disposed between the first antenna component 11 and the second antenna component 13.

One terminal of the isolation assembly 17 is electrically connected with the third section 155 of the metal board 15, and the other terminal thereof serves as the ground terminal 171 for grounding. In other words, the isolation assembly 17 can be configured for connecting the metal board 15 to the ground. The isolation assembly 17 can also be configured for isolating the first feed-in signal from the second feed-in signal. More specifically, the isolation assembly 17 can comprise an inductor 173 and a capacitor 175 which are serially connected between the ground terminal 171 and the third section 155 of the metal board 15. The inductor 173 and the capacitor 175, serving as a resonant circuit, can form a path with a low impedance when the frequency of the first feed-in signal is within the resonant frequency range of the resonant circuit so as to allow the current of the first feed-in signal to flow to the ground terminal 171; for the same reason, this resonant circuit can also form a path with a low impedance when the frequency of the second feed-in signal is within its resonant frequency range so as to allow the current of the second feed-in signal to flow to the ground terminal 171. Therefore, in the multi-feed antenna 1 where the isolation assembly 17 is disposed, the first feed-in signal and the second feed-in signal do not interfere with each other. Moreover, FIG. 1 exemplarily illustrates the serial connection between the metal board 15 and the isolation assembly 17 is in the order of the metal board 15, the capacitor 175, the inductor 173 and the ground terminal 171; however, in other embodiments, the serial connection between the metal board 15 and the isolation assembly 17 can also be in the order of the metal board 15, the inductor 173, the capacitor 175 and the ground terminal 171.

In an embodiment, the frequency of the first feed-in signal can be within the range comprising a first frequency subrange and a second frequency subrange. When the frequency of the first feed-in signal is within the first frequency subrange, the first antenna component 11 can serve as a monopole antenna to generate an electromagnetic wave; when the first feed-in signal is lower than the lower limit of the first frequency subrange and within the second frequency subrange, a coupled current corresponding to the first feed-in signal can be generated in the position, separated from the first antenna component 11 with the first gap D1, on the metal board 15, and this coupled current can flow to the ground through the isolation assembly 17. The components through which the coupled current flows serve as a loop antenna together to generate an electromagnetic wave. In this embodiment, the current path length between the first signal feed-in terminal 111 and the first free end 113 of the first antenna component 11 matches the first frequency subrange; the current path length formed by the first antenna component 11, the metal board 15 and the isolation assembly 17 matches the second frequency subrange; and the aforementioned resonant frequency of the resonant circuit included in the isolation assembly 17 is similar to or same as the second frequency subrange. The width of the first gap D1 is associated with scattering parameters (S parameters) of the loop antenna formed by the first antenna component 11, the metal board 15 and the isolation assembly 17. For the same reason, the operation method and the relation between the current path length and each frequency subrange for the second antenna component 13, the metal board 15 and the isolation assembly 17 are similar to the above, so they are not described again. In an embodiment, the current path length between the first signal feed-in terminal 111 and the first free end 113 of the first antenna component 11 is different from the current path length between the second signal feed-in terminal 131 and the second free end 133 of the second antenna component 13. In other words, the first feed-in signal and the second feed-in signal can have different operating frequency bands.

Moreover, in other embodiments, the multi-feed antenna can further comprise another one or more isolation assemblies, and another one or more antenna components. The dispositions of said another one or more isolation assemblies and said another one or more antenna components relative to the metal board are similar to those of the isolation assembly 17 and the first/second antenna component 11/13 relative to the metal board 15 as mentioned before. The antenna components and the isolation assemblies are alternately arranged so that the isolation assemblies can isolate the feed-in signals respectively received by the antenna components.

In the above embodiments, by designing a plurality of antenna components with different lengths can be designed, and combining monopole antennas and loop antennas into a construction, the multi-feed antenna may provide the wider bandwidth frequency band. Due to the disposition of the isolation assembly, two or more feed-in points can share the same parasitic ground comprising the metal board and the isolation assembly and their feed-in signals may not interfere with each other excessively. In comparison with a single-feed antenna, the multi-feed antenna in the above one or more embodiments may have a simplified construction and achieve antenna miniaturization.

Figure 2:
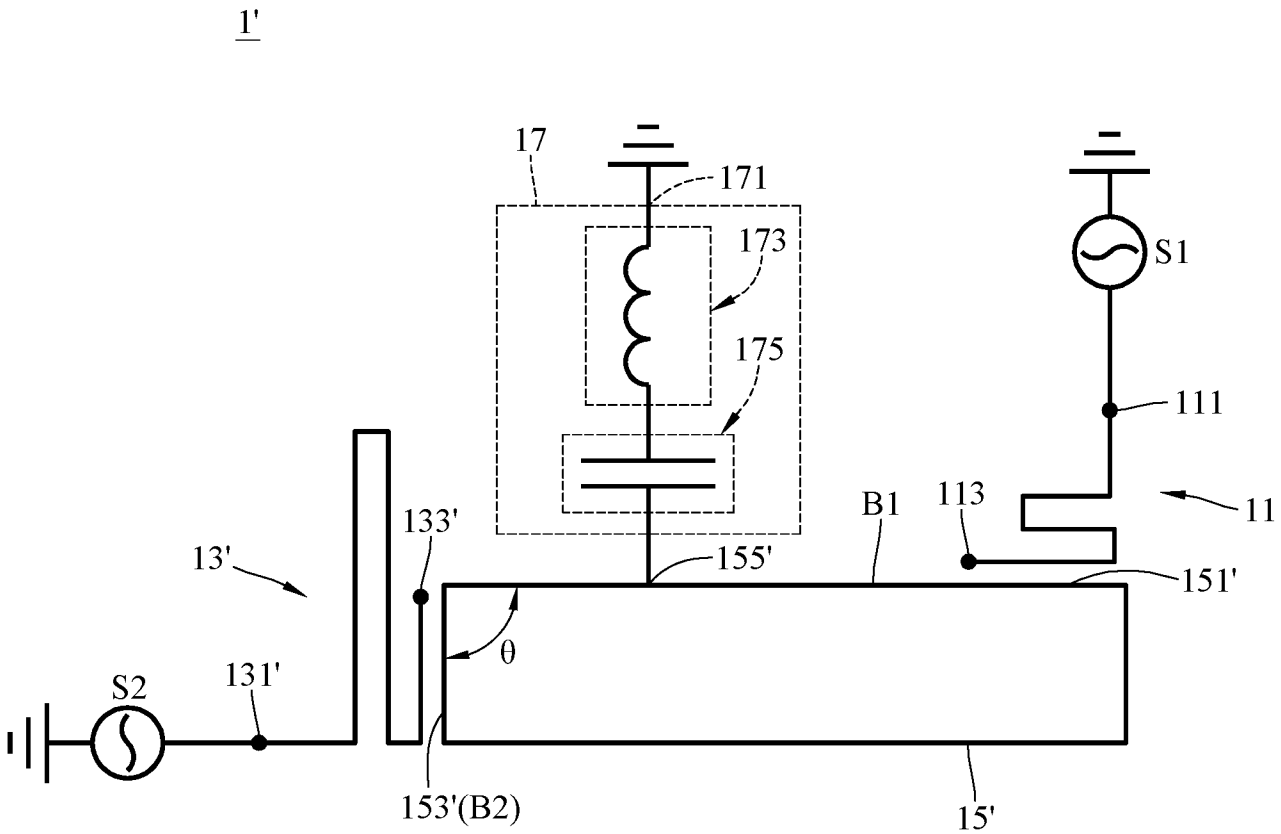
FIG. 2 is a schematic diagram of a multi-feed antenna according to another embodiment of this disclosure.

As described above, in the embodiment shown in FIG. 1, both the first antenna component 11 and the second antenna component 13 are disposed on the same side of the metal board 15. In another embodiment, the first antenna component 11 and the second antenna component 13 can be respectively disposed on the different sides of the metal board 15. Please refer to FIG. 2, wherein FIG. 2 is a schematic diagram of a multi-feed antenna 1' according to another embodiment of this disclosure. As shown in FIG. 2, the multi-feed antenna 1' comprises a first antenna component 11, a second antenna component 13', a metal board 15' and an isolation assembly 17. The first antenna component 11 comprises a first signal feed-in terminal 111 and a first free end 113; the second antenna component 13' comprises a second signal feed-in terminal 131' and a second free end 133'; the metal board 15' comprises a first section 151', a second section 153' and a third section 155' between the first section 151' and the second section 153', wherein the first section 151' and the first antenna component 11 are separated with each other, the second section 153' and the second antenna component 13' are separated with each other, and the third section 155' and the isolation assembly 17 are electrically connected with each other; the isolation assembly 17 has a ground terminal 171 for isolating the first feed-in signal and the second feed-in signal, and for example comprises an inductor 173 and a capacitor 175. These dispositions are similar to those in the embodiment shown in FIG. 1, and each of the antenna components 11 and 13' can operate in a monopole antenna mode or a loop antenna mode as mentioned in the preceding embodiments, so the related details are not repeated herein.

One of the main differences between the embodiments of FIG. 1 and FIG. 2 is the positions of the first section 151', the second section 153' and the third section 155' on the metal board 15'. In the embodiment of FIG. 2, the metal board 15' comprises a first side edge B1 and a second side edge B2, and an included angle θ is formed between the first side edge B1 and the second side edge B2. The first side edge B1 comprises the first section 151' and the third section 155' of the metal board 15', and the second side edge B2 comprises the second section 153' of the metal board 15'. In other words, the first antenna component 11 and the second antenna component 13' can be disposed respectively on the different sides of the metal board 15'. In FIG. 2, the metal board 15' is exemplarily illustrated as a rectangle, wherein the included angle θ between the first side edge B1 and the second side edge B2 is 90 degrees, and the length of the second side edge B2 is shorter than that of the first side edge B1.

In one or more embodiments of this disclosure, the aforementioned included angle θ between the first side edge B1 and the second side edge B2 can be any angle within the range of 0 to 180 degrees. Particularly, when the included angle θ is within the range of 70 to 110 degrees, the multi-feed antenna 1' has the better signal isolation effect. More particularly, when the included angle θ is 90 degrees (as a right angle exemplarily illustrated in FIG. 2), the multi-feed antenna 1' has the best signal isolation effect. More specifically, the embodiment where the included angle θ is 180 degrees is shown as the multi-feed antenna 1 in FIG. 1. In the embodiment where the included angle θ is zero degree, the first side edge B1 and the second side edge B2 corresponding to the two feed-in terminals can respectively be two parallel side edges of the metal board 15', and the isolation assembly 17 is geometrically located between the first antenna component and the second antenna component. Using FIG. 2 for explaining this disposition, the second antenna component 13' can also be disposed near the opposite side of the first side edge B1. In this disposition, the distance between the second antenna component 13' and the isolation assembly 17 is less than the distance between the second antenna component 13' and the first antenna component 11. Moreover, in FIG. 2, the metal board 15' is exemplarily illustrated as a rectangle; however, the metal board can also be designed as other shapes, which is not limited to this embodiment.

Figure 3:
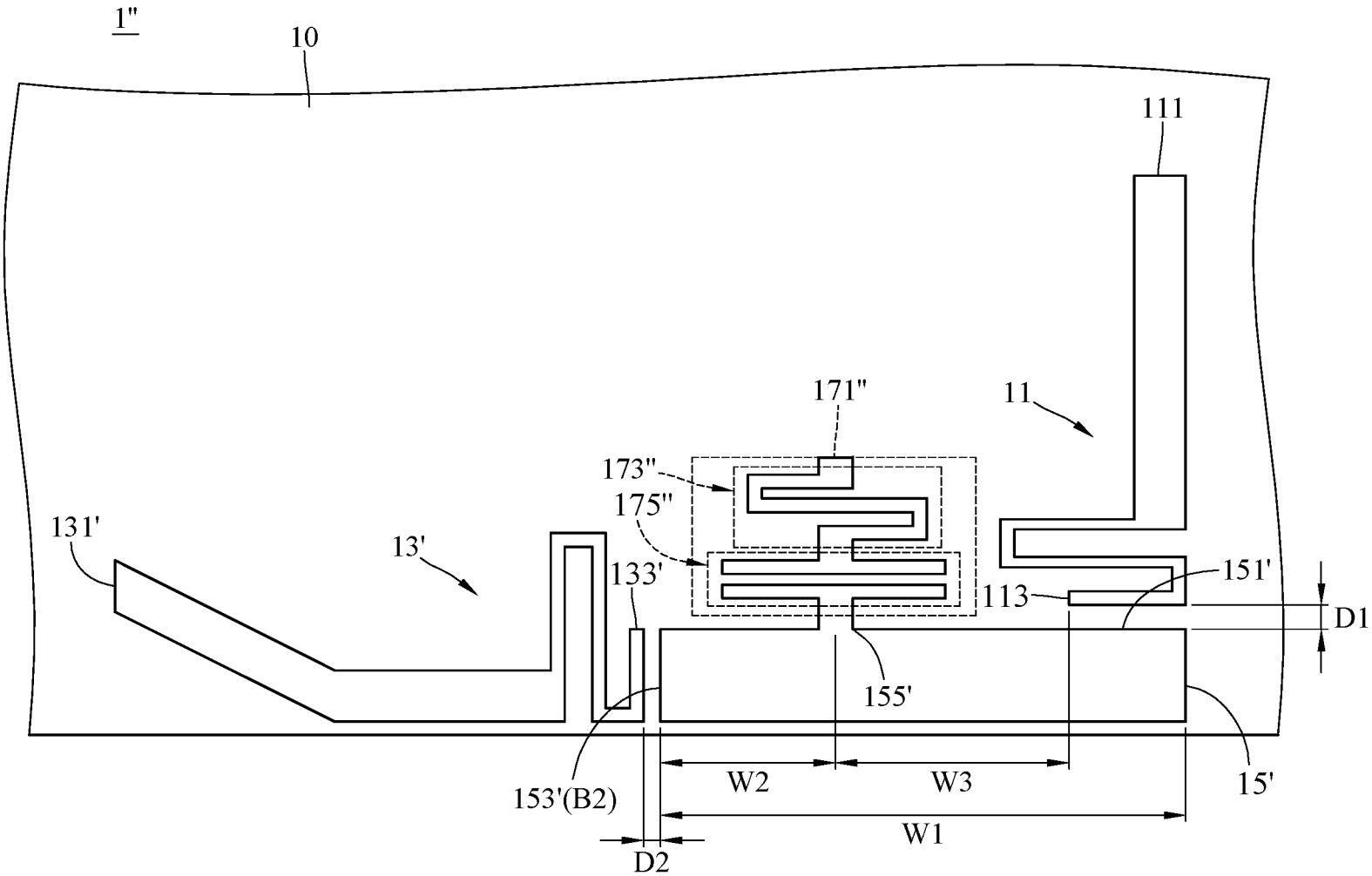
FIG. 3 is a schematic diagram of a multi-feed antenna according to yet another embodiment of this disclosure.

In the above embodiments of FIGS. 1 and 2, the constructions of the multi-feed antennas 1 and 1' are described conceptually using equivalent circuits. Please refer to FIG. 3 to exemplarily illustrate the multi-feed antenna 1" using the metal routing. FIG. 3 is a schematic diagram of the multi-feed antenna 1" according to yet another embodiment of this disclosure. The metal routing of multi-feed antenna 1" as shown in FIG. 3 corresponds to the equivalent circuit of the multi-feed antenna 1' as shown in FIG. 2 diagram. Regarding the equivalent circuit of the multi-feed antenna 1 shown in FIG. 1, its corresponding metal routing can also be performed in a manner similar to that described below, and therefore will not be described again. Corresponding to the multi-feed antenna 1' as shown in FIG. 2, the multi-feed antenna 1" shown in FIG. 3 comprises a first antenna component 11, a second antenna component 13', a metal board 15' and an isolation assembly 17". The multi-feed antenna 1" further comprises substrate 10 for the above components to be disposed on it.

The first antenna component 11 comprises a first signal feed-in terminal 111 and a first free end 113, wherein the first signal feed-in terminal 111 can be electrically connected with a first signal source via a through hole and solder; the second antenna component 13' comprises a second signal feed-in terminal 131' and a second free end 133', wherein the second signal feed-in terminal 131' can be electrically connected with a second signal source via a through hole and solder; the metal board 15' is separated from the first antenna component 11 and the second antenna component 13' respectively with a first gap D1 and a second gap D2, and electrically connected with the isolation assembly 17"; the isolation assembly 17" has a ground terminal 171" which can, for example, be connected to the ground via a through hole and solder. In this embodiment, the isolation component group 17" comprises a first metal routing line 173" and a second metal routing line 175". These two routing lines 173" and 175" are disposed on the substrate 10, and serially connect between the metal board 15' and the ground terminal 171". The first metal routing line 173" is equivalent to an inductor, which corresponds to the inductor 173 in FIG. 2; and the second metal routing line 175" is equivalent to a capacitor, which corresponds to the capacitor 175 in FIG. 2. In another embodiment, the first metal routing line 173" can be replaced with a real electronic component of an inductor, and the second metal routing line 175" can be replaced with a real electronic component of a capacitor.

Figure 4:
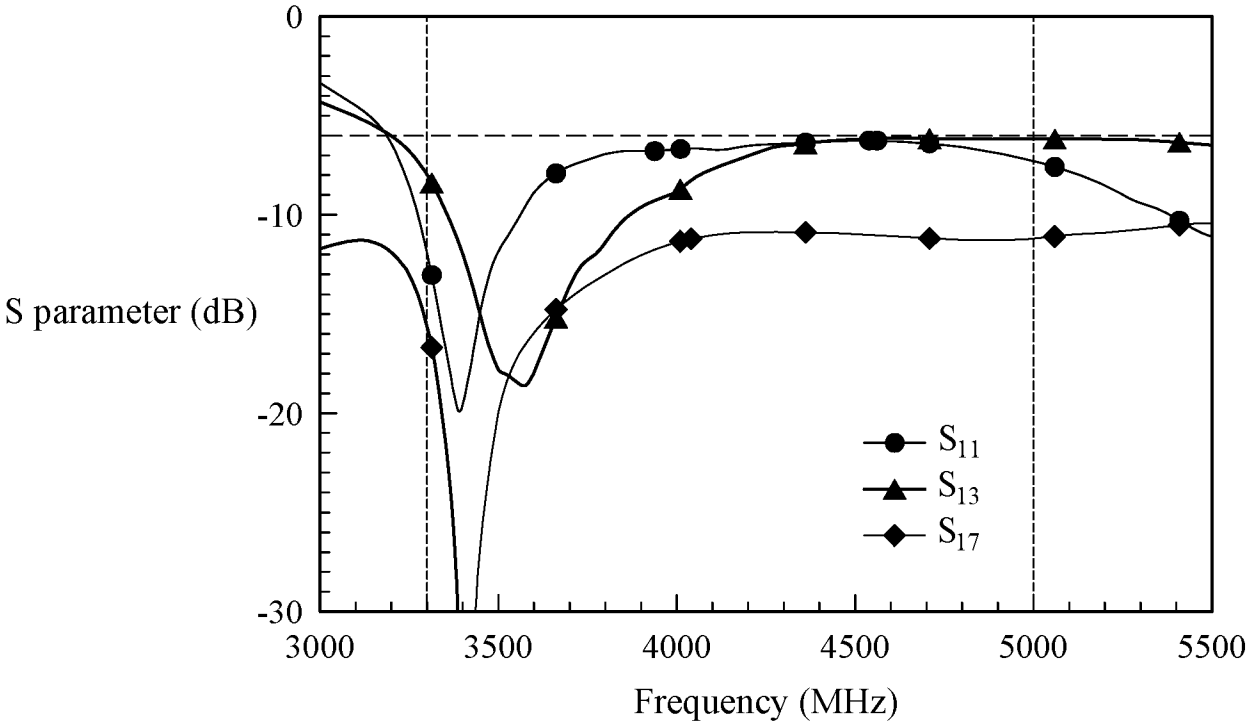
FIG. 4 is a data diagram of scattering parameters of a multi-feed antenna according to yet another embodiment of this disclosure.

As previously mentioned, by designing a plurality of antenna components with different lengths can be designed, and combining monopole antennas and loop antennas into a construction, a multi-feed antenna may provide the wider bandwidth frequency band. Please refer to FIG. 3 and FIG. 4, wherein FIG. 4 is a data diagram of scattering parameters (S parameters) of a multi-feed antenna according to yet another embodiment of this disclosure. For example, the dimensions of the multi-feed antenna 1" shown in FIG. 3 can be designed as follows: the routing length (corresponding to the aforementioned current path length) between the first signal feed-in terminal 111 and the first free end 113 of the first antenna component 11 is 25 mm; the routing length between the second signal feed-in terminal 131' and the second free end 133' of the second antenna component 13' is 28 mm; the width W1 of the metal board 15' (i.e. the width of the first side edge of the metal board 15') is 15.3 mm; the width of the first gap D1 between the metal board 15' and the first antenna component 11 is 0.7 mm; the width of the second gap D2 between the metal board 15' and the second antenna component 13' is 0.5 mm; the distance W2 between the second side edge B2 of the metal board 15' and the position where the isolation assembly 17" be located on the metal board 15' (i.e. the third section 155') is 4.8 mm, wherein the distance W2 indicates a horizontal distance parallel to the longest side of the metal board 15'; and the distance W3 between the position where the isolation assembly 17" be located on the metal board 15' (i.e. the third section 155') and the position, corresponding to the first free end 113 of the first antenna component 11, on the metal board 15' is 6.8 mm, wherein the distance W3 indicates another horizontal distance parallel to the longest side of the metal board 15'.

The multi-feed antenna 1" made based on the above design of dimensions have S parameter data as shown in FIG. 4. In FIG. 4, S parameter $S_{11}$ indicates the impedance matching performance of the first antenna component 11 in operation (comprising the aforementioned monopole antenna mode and loop antenna mode); S parameter $S_{13}$ indicates the impedance matching performance of the second antenna component 13' in operation; S parameter $S_{17}$ indicates the performance of the isolation of the first and second feed-in signals by the isolation assembly 17". As shown in FIG. 4, the multi-feed antenna 1" has the S parameter of less than −6 dB when its operating frequency band falls within the range of 3300-5000 Mhz. In other words, the multi-feed antenna 1" with the aforementioned dimensions may provide a good radiation effect in the operating frequency band of 3300-5000 Mhz.

In the embodiment shown in FIG. 3, the first antenna component 11, second antenna component 13' and the metal board 15' can be made of a conductive material such as copper, aluminum or other metal material, and they are disposed on the substrate 10. This disclosure does not limit the material of the antenna components and the metal board. In FIGS. 1-3, the first antenna component 11 and the second antenna component 13' are exemplarily illustrated in bend lines; thereby, the occupied area of the whole routing of the multi-feed antenna may be reduced. However, in other embodiments, the antenna component can also be designed to be in a straight line or other shape based on the actual accommodation space of the device where the antenna component is to be installed, such as a notebook computer, a mobile phone or other electronic device.

The multi-feed antenna as described in the above one or more embodiments can be installed in an electronic device with a networking function such as a notebook computer, a mobile phone, etc. For example, the multi-feed antenna as described in the above one or more embodiments can be disposed in the center of a side edge, close to the keyboard, of the screen side of the top cover of the notebook computer, or disposed at two ends of another side edge far from the keyboard wherein the center of said another side edge is usually configured to accommodate a camera. More particularly, two or more multi-feed antennas can be disposed in these regions, wherein each of these multi-feed antennas can be the multi-feed antenna 1 as shown in FIG. 1, or two of these multi-feed antennas which serves as two ends of this antenna serial can be the multi-feed antennas 1' as shown in FIG. 2, and be mirror symmetric with each other.

In view of the above description, the multi-feed antenna provided in this disclosure combines monopole antennas and loop antennas into a construction, and may provide the wider bandwidth frequency band. Due to the disposition of the isolation assembly, two or more feed-in points can share the same parasitic ground comprising the metal board and the isolation assembly and their feed-in signals may not interfere with each other excessively. In comparison with a single-feed antenna, the multi-feed antenna in the above one or more embodiments may have a simplified construction and achieve antenna miniaturization; thereby, in the predetermined accommodating space of the device in which the antennas are to be installed, more antennas may be installed, and maintain the appropriate distance from one another so as not to influence the wireless signal radiation performance of one another. Therefore, the requirements of the antenna arrangement for fifth generation (5G) may be satisfied.

What is claimed is:

1. A multi-feed antenna, comprising:

a first antenna component comprising a first signal feed-in terminal and a first free end, with the first signal feed-in terminal configured for receiving a first feed-in signal;

a second antenna component comprising a second signal feed-in terminal and a second free end, with the second signal feed-in terminal configured for receiving a second feed-in signal;

a metal board comprising a first section, a second section and a third section between the first section and the second section, with the first section and the first free end defining a first gap therebetween, and the second section and the second free end defining a second gap therebetween; and an isolation assembly electrically connected with the third section of the metal board, wherein the isolation assembly comprises a first metal routing line, a second metal routing line and a ground terminal, the first metal routing line and the second metal routing line are serially connected between the third section of the metal board and the ground terminal, the first metal routing line is equivalent to an inductor, the second metal routing line is equivalent to a capacitor, and the isolation assembly is configured for isolating the first feed-in signal from the second feed-in signal.

2. The multi-feed antenna according to claim 1, wherein the metal board comprises a first side edge and a second side edge, an included angle is formed between the first side edge and the second side edge, the first side edge comprises the first section and the third section, and the second side edge comprises the second section.

3. The multi-feed antenna according to claim 2, wherein the included angle is within a range of 70 to 110 degrees.

4. The multi-feed antenna according to claim 3, wherein the included angle is 90 degrees.

5. The multi-feed antenna according to claim 2, wherein a length of the second side edge is shorter than a length of the first side edge.

6. The multi-feed antenna according to claim 1, wherein the metal board comprises a side edge, wherein the side edge comprises the first section, the second section and the third section.

7. The multi-feed antenna according to claim 1, further comprising a substrate, wherein the first antenna component, the second antenna component, the metal board and the isolation assembly are disposed on the substrate.

8. The multi-feed antenna according to claim 7, wherein the metal board comprises a first side edge and a second side edge, a right angle is included between the first side edge and the second side edge, the first side edge comprises the first section and the third section, and the second side edge comprises the second section, wherein a length between the first signal feed-in terminal and the first free end of the first antenna component is 25 mm, a length between the second signal feed-in terminal and the second free end of the second antenna component is 28 mm, a width of the first side edge is 15.3 mm, a width of the first gap is 0.7 mm, a width of the second gap is 0.5 mm, a horizontal distance between the second side edge and the third section is 4.8 mm, and a horizontal distance between the third section and a position, corresponding to the first free end, on the metal board is 6.8 mm.

9. The multi-feed antenna according to claim 1, wherein a current path length between the first signal feed-in terminal and the first free end of the first antenna component is different from a current path length between the second signal feed-in terminal and the second free end of the second antenna component.

10. A multi-feed antenna, comprising:

a first antenna component comprising a first signal feed-in terminal and a first free end, with the first signal feed-in terminal configured for receiving a first feed-in signal;

a second antenna component comprising a second signal feed-in terminal and a second free end, with the second signal feed-in terminal configured for receiving a second feed-in signal;

a metal board comprising a first section, a second section and a third section between the first section and the second section, with the first section and the first free end defining a first gap therebetween, and the second section and the second free end defining a second gap therebetween; and an isolation assembly electrically connected with the third section of the metal board, wherein the isolation assembly comprises a capacitor, an inductor and a ground terminal, the capacitor and the inductor are serially connected between the third section of the metal board and the ground terminal, and the isolation assembly is configured for isolating the first feed-in signal from the second feed-in signal.

11. The multi-feed antenna according to claim 10, wherein the metal board comprises a first side edge and a second side edge, an included angle is formed between the first side edge and the second side edge, the first side edge comprises the first section and the third section, and the second side edge comprises the second section.

12. The multi-feed antenna according to claim 11, wherein the included angle is within a range of 70 to 110 degrees.

13. The multi-feed antenna according to claim 12, wherein the included angle is 90 degrees.

14. The multi-feed antenna according to claim 11, wherein a length of the second side edge is shorter than a length of the first side edge.

15. The multi-feed antenna according to claim 10, wherein the metal board comprises a side edge, wherein the side edge comprises the first section, the second section and the third section.

16. The multi-feed antenna according to claim 10, further comprising a substrate, wherein the first antenna component, the second antenna component, the metal board and the isolation assembly are disposed on the substrate.

17. The multi-feed antenna according to claim 16, wherein the metal board comprises a first side edge and a second side edge, a right angle is included between the first side edge and the second side edge, the first side edge comprises the first section and the third section, and the second side edge comprises the second section, wherein a length between the first signal feed-in terminal and the first free end of the first antenna component is 25 mm, a length between the second signal feed-in terminal and the second free end of the second antenna component is 28 mm, a width of the first side edge is 15.3 mm, a width of the first gap is 0.7 mm, a width of the second gap is 0.5 mm, a horizontal distance between the second side edge and the third section is 4.8 mm, and a horizontal distance between the third section and a position, corresponding to the first free end, on the metal board is 6.8 mm.

18. The multi-feed antenna according to claim 10, wherein a current path length between the first signal feed-in terminal and the first free end of the first antenna component is different from a current path length between the second signal feed-in terminal and the second free end of the second antenna component.

* * * * *